US012024839B2

(12) United States Patent
Wang et al.

(10) Patent No.: US 12,024,839 B2
(45) Date of Patent: Jul. 2, 2024

(54) WATER-SALT REGULATION SYSTEM AND METHOD FOR COASTAL REGIONS

(71) Applicant: Nanjing Hydraulic Research Institute, Nanjing (CN)

(72) Inventors: Xiaojun Wang, Nanjing (CN); Feng Chen, Nanjing (CN)

(73) Assignee: Nanjing Hydraulic Research Institute, Nanjing (CN)

( * ) Notice: Subject to any disclaimer, the term of this patent is extended or adjusted under 35 U.S.C. 154(b) by 93 days.

(21) Appl. No.: 17/741,018

(22) Filed: May 10, 2022

(65) Prior Publication Data

US 2022/0267975 A1 Aug. 25, 2022

(30) Foreign Application Priority Data

Dec. 27, 2021 (CN) ..... 202111617813.1

(51) Int. Cl.
*E02B 11/00* (2006.01)
*B09C 1/02* (2006.01)
*E02B 13/00* (2006.01)

(52) U.S. Cl.
CPC ..... *E02B 11/005* (2013.01); *E02B 13/00* (2013.01)

(58) Field of Classification Search
CPC ..... E02B 11/005; E02B 13/00; A01B 79/00; A01B 79/02
See application file for complete search history.

(56) References Cited

U.S. PATENT DOCUMENTS 1,595,376 A * 8/1926 Blatchley ..... E02B 11/005 405/51
1,711,308 A * 4/1929 Enderson ..... E02B 13/00 405/50
2,763,991 A * 9/1956 Kennon ..... A01M 17/002 239/548
4,721,408 A * 1/1988 Hewlett ..... E02B 13/00 405/51
2004/0253054 A1* 12/2004 Atchley ..... E03F 1/002 405/36

FOREIGN PATENT DOCUMENTS

AU 2004200171 A1 9/2004
CN 202503892 U 10/2012
CN 104206065 A 12/2014
CN 204157245 U 2/2015
CN 105359660 A * 3/2016
CN 106613594 A 5/2017
KR 2120607 B1 * 6/2020 ..... E02B 11/005

* cited by examiner

*Primary Examiner* — Benjamin F Fiorello
*Assistant Examiner* — Stacy N Lawson

(57) ABSTRACT

A water-salt regulation system for coastal regions, including an irrigation canal, a plurality of drainage channels, and a shaft. The irrigation canal is arranged on a surface farmland. The drainage channels are provided inside a soil. The irrigation canal and the drainage channels are inclined from inland to sea. The shaft is provided with a water port at which a sluice gate is provided. An inner peripheral wall of the water drainage channel is provided with a plurality of filter mesh frames with an accommodating cavity. A filter filling material is provided inside the accommodating cavity. The shaft is provided with a salinity sensor. The shaft has a first state with the sluice gate on the drainage channel closed and a second state with the sluice gate on the drainage channel opened. A water-salt regulation is also provided.

4 Claims, 8 Drawing Sheets

WATER-SALT REGULATION SYSTEM AND METHOD FOR COASTAL REGIONS

CROSS-REFERENCE TO RELATED APPLICATIONS

This application claims the benefit of priority from Chinese Patent Application No. 202111617813.1, filed on Dec. 27, 2021. The content of the aforementioned application, including any intervening amendments thereto, is incorporated herein by reference in its entirety.

TECHNICAL FIELD

This application relates to hydraulic engineering field, and more particularly to a water-salt regulation system and method for coastal regions.

BACKGROUND

Salinization is a process in which the salt rises from the bottom soil or groundwater to the surface with capillary water, and accumulates in the surface soil after evaporation. Coastal saline soil is derived from the saline silt, where the coastal saline-alkaline soils extend toward the coast, and gradually change from the non-saline-alkaline soils to light saline-alkaline soils, medium saline-alkaline soils and heavy saline-alkaline soils, with the increase of the salt content and the salinization level. The coastal saline-alkaline lands often appear in the sediment deposition areas, and due to the low and flat terrain and high groundwater level, severe soil salt accumulation will occur, aggravating the soil salinization. In addition, considering the continuous hot weather in summer, the soluble salts in the soil and groundwater in the newly-developed saline-alkaline area rise with the evaporation, and are accumulated by vapor-dissipation.

At present, the coastal saline-alkaline soil in China is mainly ameliorated through steps of: performing salt discharge and salt leaching to reduce the salt content in soil; planting salt-alkali-tolerant plants to fertilize the soil; and planting crops. Specifically, the amelioration strategy main includes: 1. water conservancy-based amelioration including drainage, irrigation and underground salt discharge; 2. chemical amelioration involving a soil conditioner, such as gypsum, phosphogypsum, calcium superphosphate, humic acid, peat, vinegar residue; and 3. bio-amelioration including planting of rice, salt-alkali-tolerant plants such as *Sesbania cannabina*, and application of microbial fertilizers. Unfortunately, these measures not only require freshwater supply, but also struggle with fragmentation, temporary effect and unsustainability. In addition, the coastal reclamation district struggles with the lack of freshwater and periodic soil salinization.

SUMMARY

An objective of this application is to provide a water-salt regulation system and method for coastal regions to perform water-salt regulation on the soil suffering primary and secondary salinization.

Technical solutions of this application are described as follows.

In a first aspect, this application provides a water-salt regulation system for coastal regions, comprising:

an irrigation canal;

a plurality of drainage channels; and a shaft;

wherein the irrigation canal is configured to be arranged on a surface farmland, and is inclined from inland to sea;

the plurality of drainage channels are configured to be arranged inside a soil, and arranged along a vertical direction; the plurality of drainage channels are inclined from inland to sea; an inner peripheral wall of each of the plurality of drainage channels is detachably provided with a plurality of first filter mesh frames; the plurality of first filter mesh frames are each provided with a accommodating cavity;

the accommodating cavity is provided with a filter filling material; and the shaft is provided with a first water port communicating with the irrigation canal and a second water port communicating with each of the plurality of drainage channels; a first sluice gate is provided at the first water port, and a second sluice gate is provided at the second water port; a salinity sensor is arranged inside the shaft; the shaft has a first state suitable for storing water with a salinity within a preset range and a second state suitable for draining water with a salinity exceeding the preset range; in the first state, the second sluice gate is closed; and in the second state, the second sluice gate is opened.

In an embodiment, a slope protection of the irrigation canal is provided with an anti-corrosion layer.

In an embodiment, a bottom of the shaft is provided with a gravel filter layer or a biochar filter layer; and a peripheral wall of the shaft is detachably provided with a plurality of second filter mesh frames.

In an embodiment, the water-salt regulation system further comprises a freshwater storage tank configured to be suitable for arrangement along a planting row or at an edge and corner of a field.

In an embodiment, both sides of the irrigation canal are each provided with a water vapor collection device; the water vapor collection device comprises a plurality of support frames and a collection mesh; the collection mesh is connected to the plurality of support frames, and covers a space between adjacent two support frames; the plurality of support frames have an extendable-retractable structure; the plurality of support frames on both sides of the irrigation canal are configured to be in contact when in a working state; in the working state, the plurality of support frames cover the irrigation canal and the shaft, and an inner side of the collection mesh is configured to collect water vapor to allow the water vapor to flow back to the irrigation canal or soils at both sides of the irrigation canal along the collection mesh.

In an embodiment, each of the plurality of support frames comprises two fixed parts and two sliding parts; the two fixed parts each have an arc structure; one end of each of the two fixed parts is configured to be fixed in the soil, and the other end of each of the two fixed parts is configured to bend toward the irrigation canal; one side of the collection mesh is fixed at a connection between each of the two fixed parts and the soil, and the other side of the collection mesh is connected with the two sliding parts; and the collection mesh is configured to slide with the two sliding parts to cover the irrigation canal and the shaft.

In an embodiment, an end of one of the two sliding parts is fixedly provided with a first connecting block, and an end of the other of the two sliding parts is fixedly provided with a second connecting block; the first connecting block and the second connecting block are respectively provided with a through hole, and through holes of the first connecting block and the second connecting block are aligned with each other; when the two sliding parts are in contact with each other, the first connecting block is in bolted connection with the second connecting block to fix the two sliding parts.

In an embodiment, one of the two sliding parts is provided with a first connecting rope, and the other of the two sliding parts is provided with a second connecting rope; and the two sliding parts are connected by the first connecting rope and the second connecting rope.

By arranging the irrigation canal, the plurality of drainage channels, the shaft and the salinity sensor in the coastal farmland regions, the comprehensive utilization of water-salt movement in the coastal farmland regions and the real-time monitoring of the salinity are enabled. When the salinity is within the preset range, the farmland is allowed to be irrigated, and when the salinity exceeds the preset range, the water is drained into the sea. The inner peripheral wall of each water drainage channel is provided with several first filter mesh frames to filter the water penetrating into the drainage channels, so as to lower the water salinity. Considering that the irrigation canal and the drainage channels are all inclined to the sea, the water therein can flow freely into the sea, facilitating the drainage of the water with a salinity exceeding the preset range. The farmland can be irrigated by opening the sluice gate between the irrigation canal and the shaft. The water with a salinity exceeding the preset range is drained by shutting the sluice gate between the drainage channels and the shaft. It is possible to store the water within a preset salinity range by shutting the sluice gate between the drainage channels and the shaft.

Compared with the prior art, the water-salt regulation system provided herein can delay the salt migration through the coordination of the irrigation canal, drainage channels and shaft, so as to mitigate the waste of water resources and salt accumulation in the coastal regions. As a consequence, the water-salt regulation system provided herein can improve the soil condition of the coastal farmland region and enhance the soil utilization rate in the coastal farmland region.

In a second aspect, this application provides a water-salt regulation method, comprising:

selecting a coastal region and collecting topographical data, meteorological data and crop structure data in the selected coastal region; based on the topographical data, meteorological data and crop structure data, arranging an irrigation canal, a plurality of drainage channels and a shaft in the selected coastal region, wherein the irrigation canal and the plurality of drainage channels are inclined from inland to sea, and are communicated with the shaft; arranging a freshwater storage tank and a water vapor collection device in the selected coastal region according to the topographical data, and data of the canal and groundwater level; monitoring a salinity of water in real time during use; when the salinity of water exceeds a preset value, draining the water through the plurality of drainage channels; and when the salinity is lower than the preset value, storing the water and draining excess water.

Compared to the prior art, this application has the following beneficial effects.

1. In the coastal farmland regions, the irrigation-underdrainage system designed based on the water-salt movement is laid out, which realizes the integrated, systematic and precise management of the water-salt movement in this region. Through the three-dimensional real-time monitoring and quantitative regulation and control of the water-salt movement process, the allocation and utilization of the diversion water and rainfall in this region is optimized.

2. According to the water-salt movement pattern, the water vapor collection device is introduced to mitigate the evaporation from the water surface, and the salt is discharged in time via the shaft and the drainage channels. The upward accumulation of salt in the coastal farmland regions is reduced within the coastal regions from two aspects of salinity and dynamics, which effectively alleviates the secondary salinization in the coastal region.

3. By means of the layered arrangement of the drainage channels, the real-time monitor and regulation of the groundwater level and salinity near the surface of coastal farmland is enabled, facilitating improving the soil condition. Therefore, this application is highly potential to be applied to the amelioration of coastal soil with periodic salinization.

Figure 1:
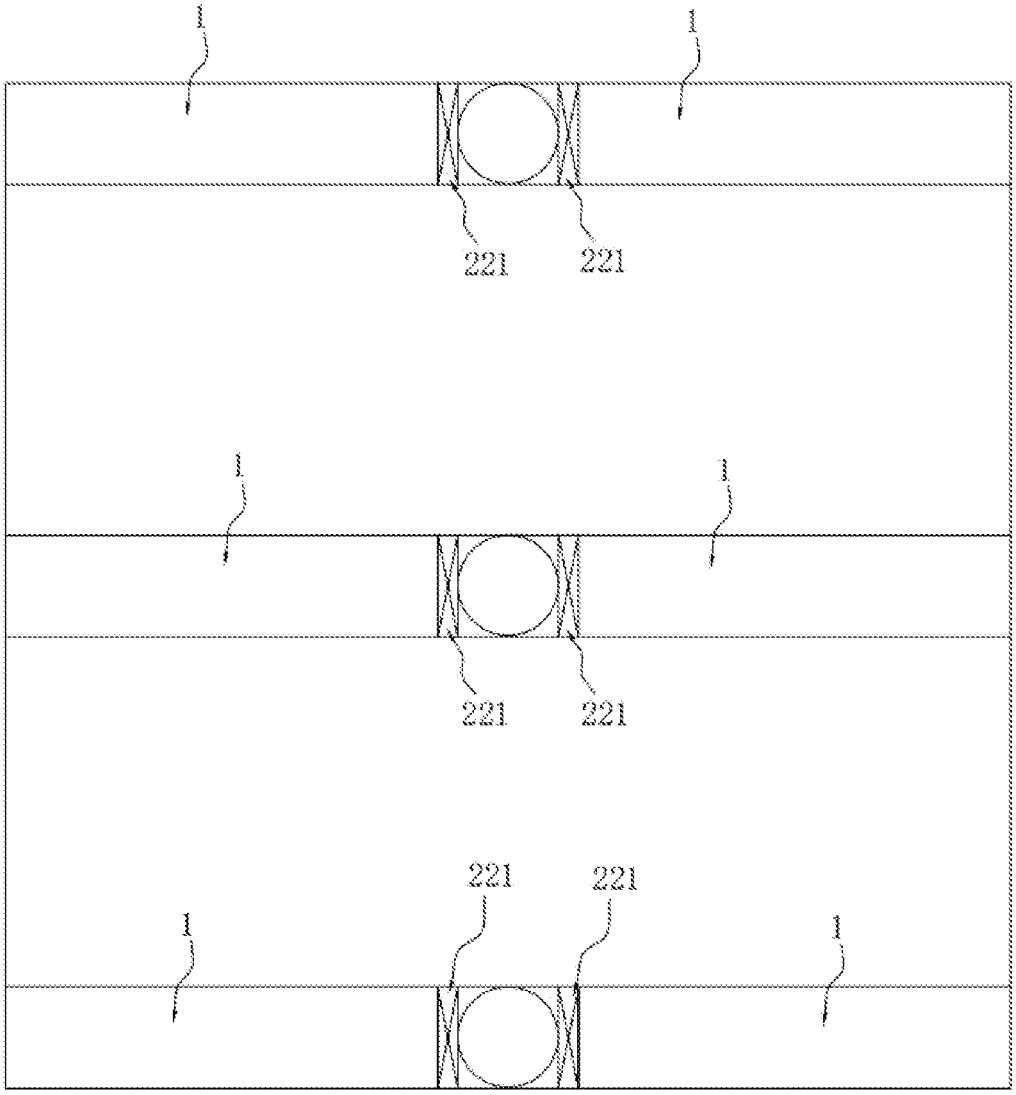
FIG. 1 is a top view of an irrigation canal and a shaft of a water-salt regulation system according to an embodiment of this application.
Figure 2:
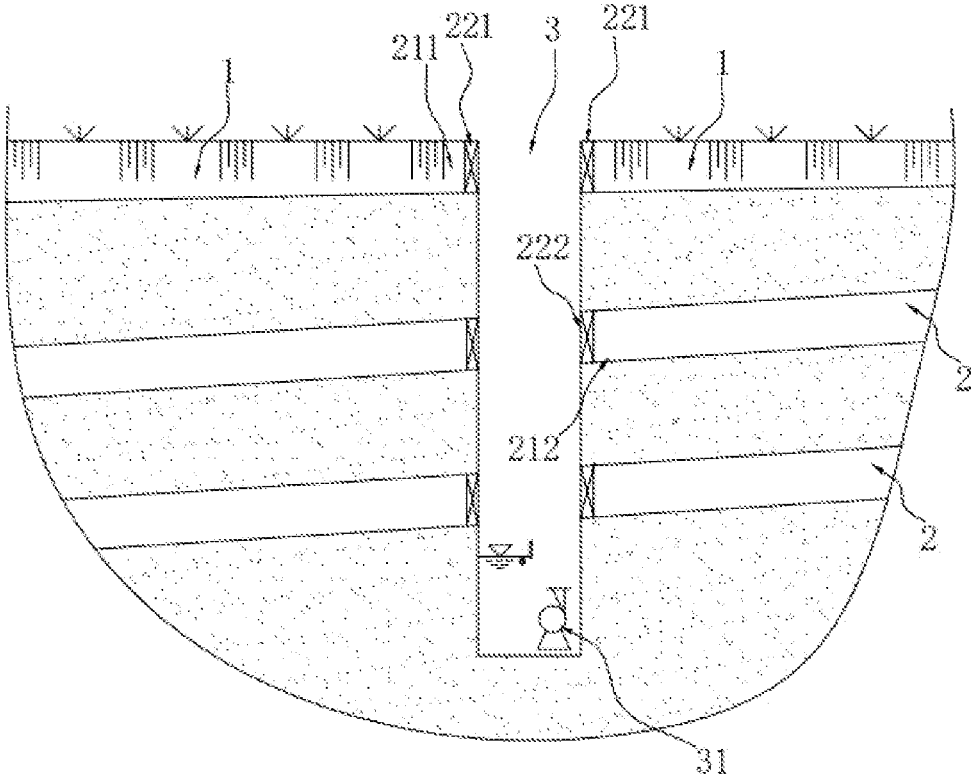
FIG. 2 is a cross-sectional view of drainage channels and the shaft according to an embodiment of this application.
Figure 3:
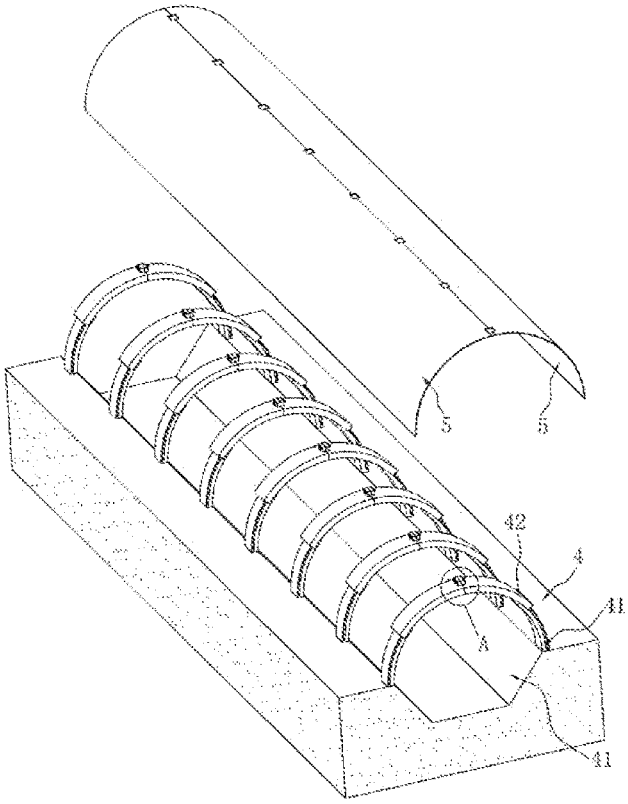
FIG. 3 schematically shows a collection mesh and support frames of the water-salt regulation system according to an embodiment of this application.
Figure 4:
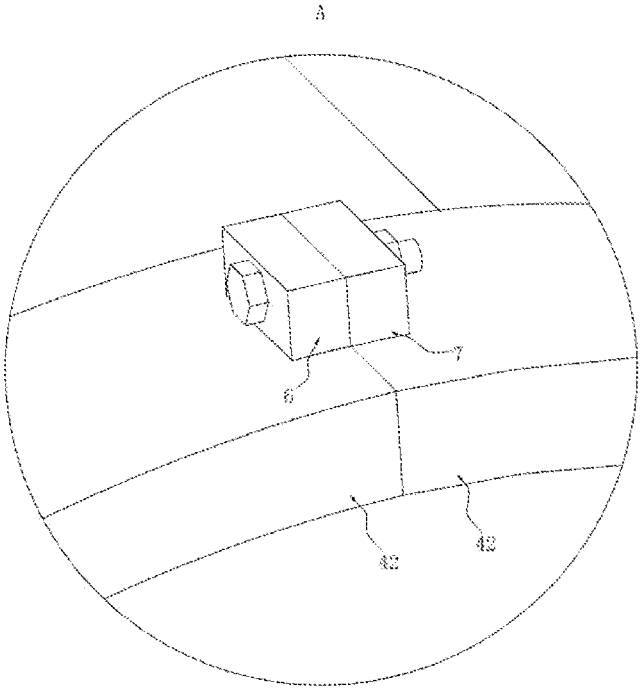
FIG. 4 is an enlarged view of part A in FIG. 3.
Figure 5:
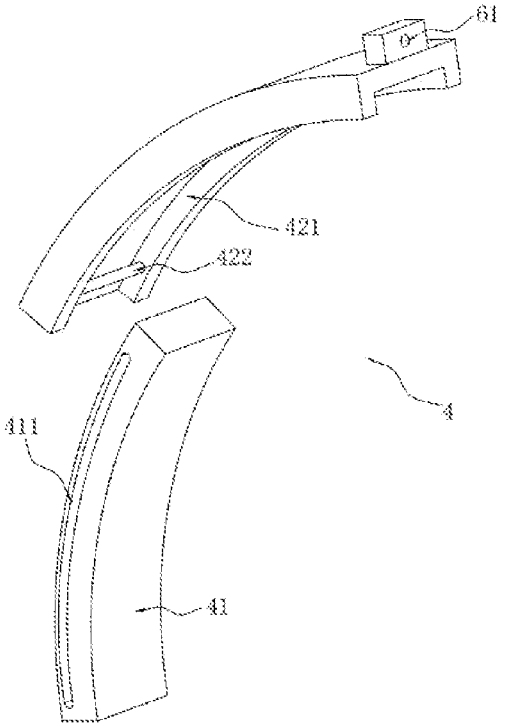
FIG. 5 schematically shows the support frame according to an embodiment of this application.
Figure 6:
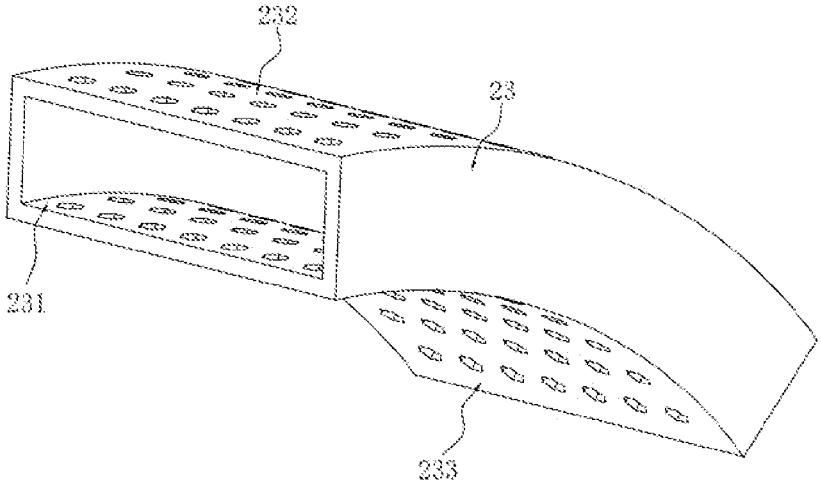
FIG. 6 schematically shows an accommodating cavity of the water-salt regulation system according to an embodiment of this application.
Figure 7:
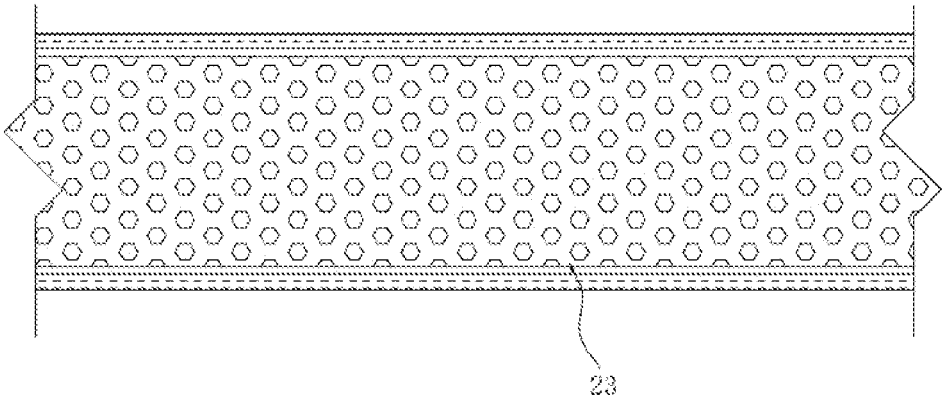
FIG. 7 schematically shows a filter mesh frame according to an embodiment of this application.

In the drawings: 1: irrigation canal; 2: water drainage channel; 211: first water port; 212: second water port; 221: first sluice gate; 222: second sluice gate; 23: first filter mesh frame; 231: accommodating cavity; 232: contact surface; 233: water-permeable surface; 3: shaft; 31: water pump; 4: support frame; 41: fixed part; 411: arc limiting groove; 42: sliding part; 421: arc groove; 422: limiting rod; 5: collection mesh; 6: first connecting block; 61: through hole; and 7: second connecting block.

DETAILED DESCRIPTION OF EMBODIMENTS

In order to clearly explain the technical problems, technical solutions and beneficial effects of this application, this application will be further described in detail below with reference to the accompanying drawings and embodiments. It should be understood that the embodiments provided herein are merely illustrative of this application, but not intended to limit the application.

Referring to embodiments shown in FIGS. 1-7, a water-salt regulation system for coastal regions is illustrated, which includes an irrigation canal 1, a plurality of drainage channels 2, and a shaft 3. The irrigation canal 1 is configured to be arranged on a surface farmland, and is inclined from inland to sea. The plurality of drainage channels 2 are configured to be arranged inside a soil, and arranged along a vertical direction. The plurality of drainage channels 2 are inclined from inland to sea. The shaft 3 is provided with a first water port 211 communicating with the irrigation canal 1 and a plurality of second water ports 212 respectively communicating with the drainage channels 2. A first sluice gate 221 is provided at the first water port 211, and a second sluice gate 222 is provided at each of the second water ports 212. An inner peripheral wall of each of the plurality of drainage channels 2 is detachably provided with a plurality of first filter mesh frames 23. The plurality of first filter mesh frames 23 are each provided with an accommodating cavity 231. The accommodating cavity 231 is provided with a filter filling material. A salinity sensor is arranged inside the shaft 3. The shaft 3 has a first state suitable for storing water with a salinity within a preset range and a second state suitable for draining water with a salinity exceeding the preset range. In the first state, the second sluice gate is closed, and in the second state, the second sluice gate is opened.

In this embodiment, by arranging the irrigation canal 1, the plurality of drainage channels 2, the shaft 3 and the salinity sensor in the coastal farmland regions, the comprehensive utilization of water-salt movement in the coastal farmland regions and the real-time monitoring of the water salinity are enabled. When the water salinity is within the preset salinity range, the farmland is allowed to be irrigated. When the water salinity exceeds the preset range, the water is drained into the sea. The inner peripheral wall of each water drainage channel 2 is provided with several first filter mesh frames 23 to filter the water penetrating into the drainage channels 2, so as to lower the water salinity. Considering that the irrigation canal 1 and the drainage channels 2 are all inclined to the sea, the water therein can flow into the sea, facilitating the drainage of the water with a salinity exceeding the preset range. The farmland can be irrigated by opening the first sluice gate 221 between the irrigation canal 1 and the shaft 3. The water with salinity exceeding the preset value is drained by shutting the second sluice gate 222 between the drainage channels 2 and the shaft 3. It is possible to store the water within a preset salinity range by shutting the second sluice gate 222 between the drainage channels 2 and the shaft 3.

Compared with the prior art, the water-salt regulation system provided herein can improve the soil condition of the coastal farmland region and enhance the soil utilization rate in the coastal farmland region through the cooperation of the irrigation canal 1, the plurality of drainage channels 2 and the shaft 3.

It should be noted that a flow capacity of the irrigation canal 1 is dependent on farmland region, irrigation strategy and rainfall. The water demand transported by the irrigation canal 1 to the farmland is equal to the estimated water demand of the crops within the controlled range, where a cross-section of the irrigation canal 1 can be trapezoidal, U-shaped or trapezoidal with curved bottom. The irrigation canal 1 has a fixed width, and the cross-section of the irrigation canal 1 is determined by the water flow capacity of the irrigation canal 1. The bottom gradient of the irrigation canal 1 is mainly in an east-west direction. The east is close to the sea, and thus an east side of the irrigation canal 1 is lower than a west side. The bottom gradient is set within a range of 1/500~1/5000 to enable the gravity irrigation.

In addition, the drainage channels 2 are located underground, and are arranged in at least two layers. The first layer of drainage channels 2 is arranged at 0.2~0.6 m underground, and the specific depth needs to be determined according to the crop growth in the coastal farmland region. The second layer of drainage channels 2 is arranged at 0.8~3 m underground, which is determined by burial depth of groundwater level, longitudinal gradient of an underpass and gradient of the ground.

The number of the drainage channels 2 can be adjusted according to local conditions. A distance between the drainage channels 2 is determined by drainage intensity of the controlled farmland region. A drainage direction of the drainage channels 2 is designed from west to east, and from the inland to the sea. The cross-section of the drainage channels 2 can be in a form of circle, upper circle-lower square and rectangle. A gradient of the water drainage channel 2 is within a range of 1/500~1/3000, and is determined according to the local groundwater level and ground gradient.

Referring to embodiments shown in FIGS. 1-7, a slope protection of the irrigation canal 1 is provided with an anti-corrosion layer. In this case, the slope protection of the irrigation canal 1 can be effectively protected from being corroded, so as to prolong the service life of the slope protection of the irrigation canal 1.

Referring to some embodiments shown in FIGS. 1-7, the shaft 3 is provided with a water pump 31 and a water level gauge, and a depth of the shaft 3 is determined by the groundwater level, usually 5-15 m underground. The shaft 3 is configured to not only adjust and control the groundwater level, and act as a transit station of irrigation, drainage and desalination, but also store the water. A diameter of the shaft 3 is determined by the farmland region within the controlled range and the demand for irrigation and drainage, and generally is set within a range of 1-10 m. A bottom of the shaft 3 is provided with a gravel filter layer or a biochar filter layer for filtration. A thickness of the gravel filter layer or the biochar filter layer is 0.2-1 m. The peripheral wall of the shaft 3 is detachably provided with the second filter mesh frames, so as to filter the water infiltrating into the shaft 3 to lower the salt content. The plurality of second filter mesh frames are replaceable, facilitating the daily maintenance and repair.

It should be noted that the plurality of first filter mesh frames 23 have a contact surface 232 in contact with the inner peripheral wall of the water drainage channel 2 and a water-permeable surface 233 away from the inner peripheral wall of the water drainage channel 2. The plurality of first filter mesh frames 23 are each provided with an opening communicating with the accommodating cavity 231, which enables a filter filling material to be filled into the accommodating cavity 231, and also facilitates the replacement of the filter filling material. The filter filling materials are mainly composed of degradable biochar made of waste biomass, for example, crop straws, fruit branches, poultry manure, which are conducive to the improvement of the saline-alkaline soil. The first filter mesh frames 23 have a thickness of 0.05~0.5 m.

In addition, the above-mentioned filter filling material can be packaged in a bag, which is then loaded in the accommodating cavity 231 of the plurality of first filter mesh frames 23. The bag is configured to be water-permeable, and also to accommodate the above-mentioned filter filling materials, facilitating the replacement of the filter filling material. The first filter mesh frames 23 are connected with the inner peripheral wall of the drainage channels 2 via a stainless-steel bolt.

Referring to some embodiments shown in FIGS. 1-7, the water-salt regulation system further includes a freshwater storage tank, which is configured to be suitable for arrangement along a planting row or at an edge and corner of a field. The freshwater storage tank accounts for 5%-20% of the farmland region without affecting the crop growth. The above-mentioned arrangement enables the storage of freshwater and irrigation of the crops using the freshwater stored in the freshwater storage tank when needed.

Referring to some embodiments shown in FIGS. 1-7, both sides of the irrigation canal 1 are each provided with a water vapor collection device. The water vapor collection device includes a plurality of support frames 4 and a collection mesh 5. The collection mesh 5 is connected to the plurality of support frames 4 and covers a space between adjacent two support frames 4. The plurality of support frames 4 have an extendable-retractable structure. The plurality of support frames 4 on both sides of the irrigation canal 1 are configured to be in contact when in a working state. In a working state, the plurality of support frames 4 cover the irrigation canal 1 and the shaft 3. An inner side of the collection mesh 5 is configured to collect water vapor to allow the water vapor to flow back to the irrigation canal 1 or soils at both sides of the irrigation canal 1 along the collection mesh 5. The collection mesh 5 is covered on the irrigation canal 1 and the shaft 3 by the cooperation of the plurality of support frames to allow the water vapor evaporated from the water surface recycled and penetrated into the nearby soils or the irrigation canal 1 through the collection mesh 5 and the plurality of support frames 4, thereby mitigating the salt accumulation caused by the water evaporation.

Referring to some embodiments shown in FIGS. 1-7, each of the plurality of support frames 4 includes two fixed parts 41 and two sliding parts 42. The two fixed parts 41 each have an arc structure. One end of each of the two fixed parts 41 is configured to be fixed in the soil, and the other end of each of the two fixed parts is configured to bend toward the irrigation canal 1. One side of the collection mesh 5 is fixed at a connection between the each of the two fixed parts 41 and the soil, and the other side of the collection mesh 5 is connected with the two sliding parts 42. The collection mesh 5 is configured to slide with the two sliding parts 42 to cover the irrigation canal 1 and the shaft 3. By the arrangements mentioned above, when the two sliding parts 42 on both sides of the irrigation canal 1 are in contact with each other, the collection mesh 5 and the plurality of support frames 4 are formed into an arc-shaped structure above the irrigation canal 1 to allow the water vapor accumulated at an inner side of the collection mesh 5 to flow along the collection mesh 5 and the plurality of support frames 4, so as to flow back to the soil or the irrigation canal 1.

It should be noted that the plurality of support frames 4 are provided along a length direction of the irrigation canal 1. The collection mesh 5 can be made of a transparent plastic film. One side of the plastic film is fixed on the soil, and the other side is fixed on the two sliding parts 42. After the two sliding parts 42 slide, the plastic film covers the irrigation canal 1, which can reduce the evaporated water vapor. Each of the two sliding parts 42 has an arc groove 421 slidably matched with each of the two fixed parts 41. Each of the two sliding parts 42 is slidably matched with the corresponding fixed part 41 through the arc groove 421 to limit the sliding direction of the two sliding parts 42. After the two sliding parts 42 slide, the two sliding parts 42 on both sides of the irrigation canal 1 can be in contact with each other.

In addition, each of the two fixed parts 41 is provided with an arc limiting groove 411. The arc groove 421 on each of the two sliding parts 42 is provided with a limiting rod 422. The limiting rod 422 is configured to be in plug-in connection with the arc limiting groove 422 and slide along the arc limiting groove 411. The limiting rod 422 is fixed on each of the two sliding parts 2. The arrangements mentioned above enable the limitation of the positions of the two fixed parts 41 and the two sliding parts 42, reducing the occurrence of the separation between each of the two sliding parts 42 and each of the two fixed parts 41.

Referring to some embodiments shown in FIGS. 1-7, an end of one of the two sliding parts 42 is fixedly provided with a first connecting block 6, and an end of the other of the two sliding parts 42 is fixedly provided with a second connecting block 7. The first connecting block 6 and the second connecting block 7 are respectively provided with a through hole 61, and through holes 61 of the first connecting block 6 and the second connecting block 7 are aligned with each other. When the two sliding parts 42 are in contact with each other, the first connecting block 6 is in bolted connection with the second connecting block 7 to fix the two sliding parts 42. The above arrangement enables the fixation of the two sliding parts 42, so as to allow the collection mesh to cover the irrigation canal 1.

Referring to some embodiments shown in FIGS. 1-7, one of the two sliding parts 42 is provided with a first connecting rope, and the other of the two sliding parts 42 is provided with a second connecting rope; and the two sliding parts 42 are connected by the first connecting rope and the second connecting rope. After the two sliding parts 42 slide, the two sliding parts 42 can be fixed together by tying the first connecting rope on one of the two sliding parts 42 and the second connecting rope on the other of the two sliding parts, so as to allow the collection mesh 5 to cover the irrigation canal 1 and the shaft 3.

Three operation modes of the water-salt regulation system will be illustrated as follows.

Figure 8:
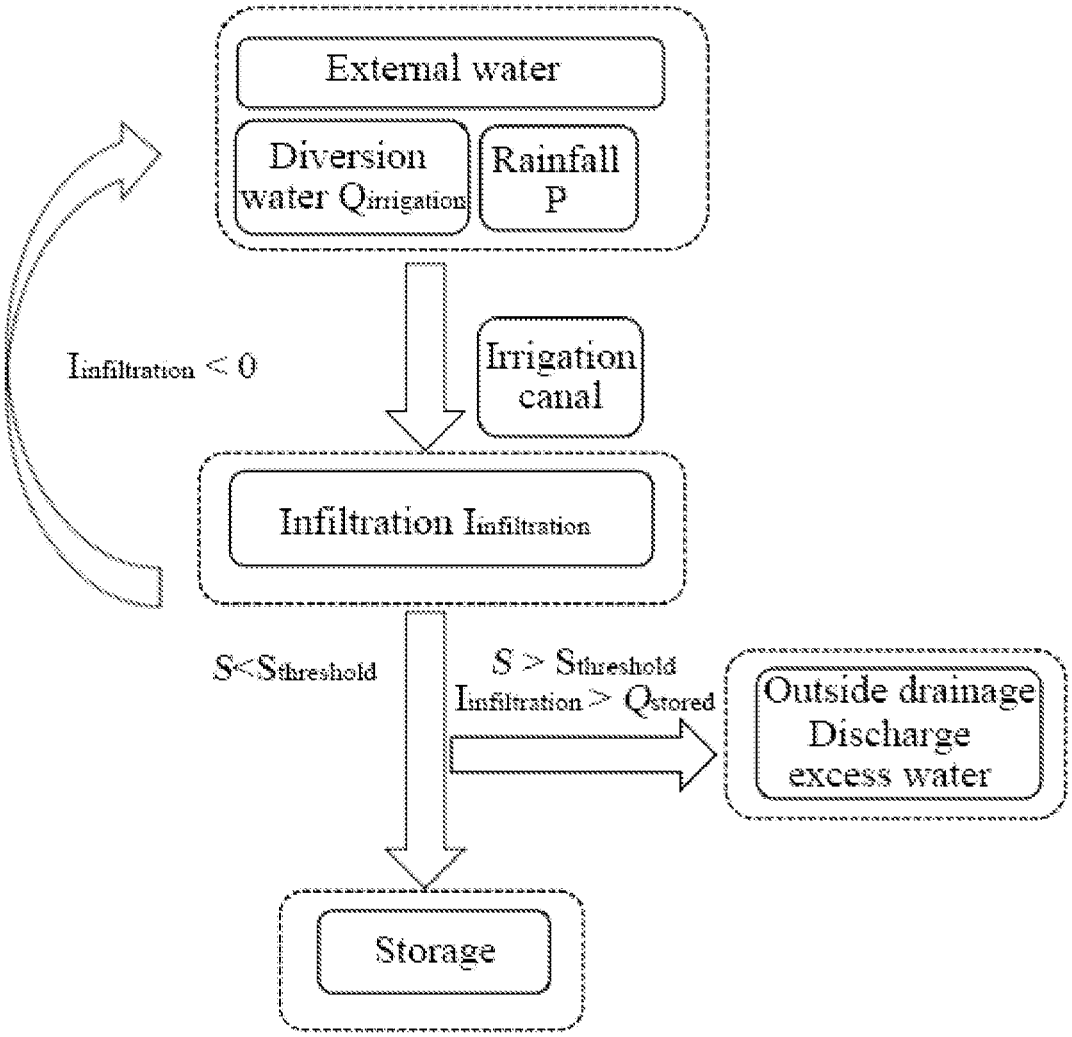
FIG. 8 illustrates an external water supply mode according to an embodiment of this application.

1. An external water supply mode is illustrated in FIG. 8: $I_{infiltration}=Q_{irrigation}+P-Q_{actual\ water\ demand}$. The external water can be rainfall or irrigation water. When the crops is irrigated or rainfall occurs during the growth, the amount of infiltration water in the farmland region, $I_{infiltration}$, is calculated by subtracting an actual water demand of the farmland crops within the controlled range, $Q_{actual\ water\ demand}$, from a sum of the amount of water transported via the irrigation canal 1 to the farmland region, $Q_{irrigation}$, and the amount of the rainfall, P, during the same period.

1) When $I_{infiltration}<0$, the crops should be supplemented with irrigation water in time as needed.

2) When $0<I_{infiltration}<Q_{stored}$, according to the real-time monitoring data, when the salt content of the infiltration water is in accord with the irrigation condition of $S<S_{threshold}$, that is when the salinity of the infiltration water is less than the preset salinity, the $I_{infiltration}$ is directly stored in the plurality of drainage channels 2, the shaft 3 and the irrigation canal 1, and when the salt content exceeds the salt content of the crop irrigation water, that is $S>S_{threshold}$, the infiltration water with excessive salt content is drained outside the controlled farmland region layer by layer through the plurality of drainage channels 2 and the shaft 3.

3) When $I_{infiltration}>Q_{stored}$, the water is drained outside via the shaft 3 and the plurality of drainage channels 2, where $Q_{stored}=Q_{stored\ in\ irrigation\ canal}+Q_{stored\ in\ drainage\ channels}+Q_{stored\ in\ shaft}$. The amount of stored water, $Q_{stored}$, equals to a sum of the amount of water stored in the irrigation canal 1, $Q_{stored\ in\ irrigation\ canal}$, the amount of water stored in the plurality of drainage channels 2, $Q_{stored\ in\ drainage\ channels}$, and the amount of water stored in the shaft 3, $Q_{stored\ in\ shaft}$. It should be noted that the irrigation canal 1 can be arranged in plural in the farmland region. Each irrigation canal 1 is provided with the water drainage channel 2. The shaft 3 is arranged in plural on each irrigation canal 1. The above amount of stored water equals to the sum of the amount of water stored in the irrigation canal 1, the amount of water stored in the plurality of drainage channels 2, and the amount of water stored in the shaft 3. The amount of stored water in the irrigation canal 1, the drainage channels 2 and the shaft 3 can be obtained by calculation.

Figure 9:
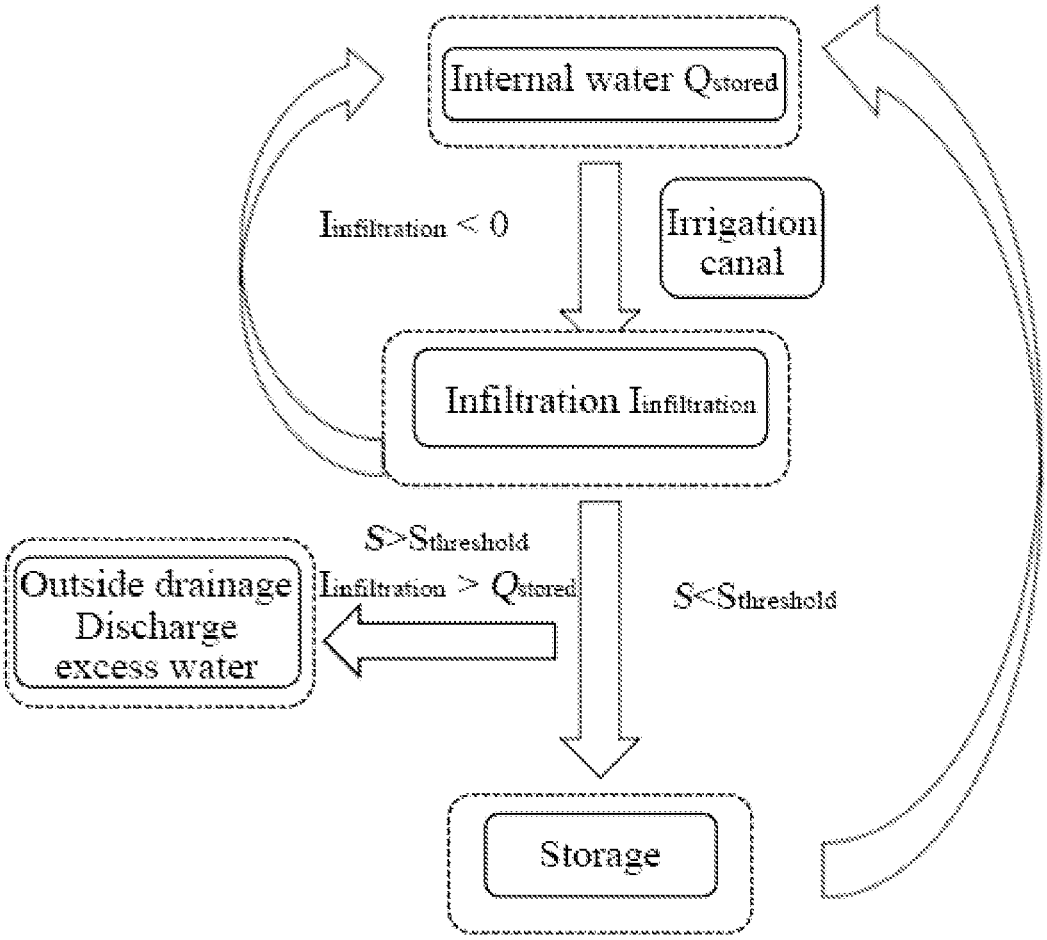
FIG. 9 illustrates an internal circulation mode according to an embodiment of this application.

2. An internal circulation mode is illustrated in FIG. 9: when a farmland within the controlled range requires an irrigation or a salt leaching, but without the irrigation or the rainfall, the stored water, $Q_{stored}$, is introduced from the shaft 3 into the irrigation canal 1, while the collection mesh 5 is allowed to cover the shaft 3 into the irrigation canal 1, so as to reduce the evaporated water vapor. $I_{infiltration}=Q_{stored}-Q_{actual\ water\ demand}$, where the amount of infiltration water in the farmland region, $I_{infiltration}$, is calculated by subtracting the actual water demand of the farmland crops within the controlled range, $Q_{actual\ water\ demand}$, from the amount of water stored in the drainage channels 2 and the shaft 3, $Q_{stored}$.

1) When $I_{infiltration}<0$, the crops should be supplemented with irrigation water in time as needed.

2) When $I_{infiltration}>0$, according to the real-time monitoring data, when the salt content of the infiltration water is in accord with the irrigation condition of $S<S_{threshold}$, the $I_{infiltration}$ is directly stored in the plurality of drainage channels 2, the shaft 3, and when the salt content exceeds the salt content of the crop irrigation water, that is $S>S_{threshold}$, the infiltration water with excessive salt content is drained outside the controlled farmland region layer by layer through the plurality of drainage channels 2 and the shaft 3.

Figure 10:
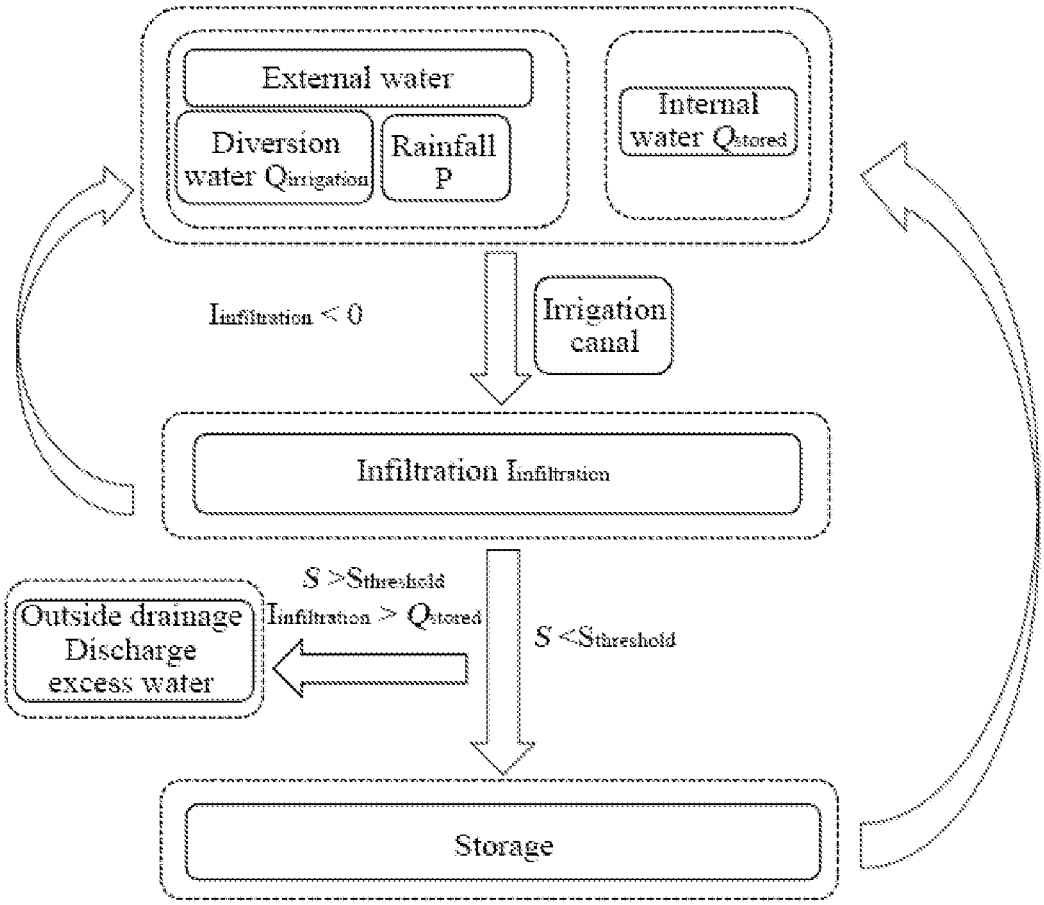
FIG. 10 depicts an external water-internal circulation combined mode according to an embodiment of this application.

3. The external water-internal circulation combined mode is illustrated in FIG. 10: when the crops is irrigated or rainfall occurs during the growth, the stored water is used at the same time. $I_{infiltration}=Q_{irrigation}+Q_{stored}+P-Q_{actual\ water\ demand}$, where the amount of the infiltration water in the farmland region, $I_{infiltration}$, is calculated by subtracting the actual water demand of the farmland crops within the controlled range, $Q_{actual\ water\ demand}$, from a sum of the amount of water transported via the irrigation canal 1 to the farmland region, $Q_{irrigation}$, the amount of water stored in the plurality of drainage channels 2 and the shaft 3, $Q_{stored}$, and the amount of the rainfall, P, during the same period.

1) When $I_{infiltration}<0$, the crops should be supplemented with irrigation water in time as needed.

2) When $0<I_{infiltration}<Q_{stored}$, according to the real-time monitoring data, when the salt content of the infiltration water is in accord with the irrigation condition of $S<S_{threshold}$, the $I_{infiltration}$ is directly stored in the plurality of drainage channels 2, the shaft 3 and the irrigation canal 1, and when the salt content exceeds the salt content of the crop irrigation water, that is $S>S_{threshold}$, the infiltration water with excessive salt content is drained outside the controlled farmland region layer by layer through the plurality of drainage channels 2 and the shaft 3.

3) When $I_{infiltration}>Q_{stored}$, with the salt content of the infiltration water in accord with the irrigation condition, the excess water is drained outside via the shaft 3 and the plurality of drainage channels 2, and when the salt content exceeds the salt content of the crop irrigation water, the infiltration water is all drained outside.

Based on the same concept, in this embodiment of this application provides a water-salt regulation method, which is performed by the following steps.

A coastal region is selected, and topographical data, meteorological data and crop structure data in the selected coastal region are collected. Based on the topographical data, meteorological data and crop structure data, an irrigation canal 1, a plurality of drainage channels 2 and a shaft 3 are arranged in the selected coastal region, where the irrigation canal 1 and the plurality of drainage channels 2 are inclined from inland to sea, and are communicated with the shaft 3. A freshwater storage tank and a water vapor collection device are arranged in the selected coastal region according to the topological data, and data of the canal and groundwater level. A salinity of water is monitored in real time during use. When the salinity of water exceeds a preset salinity value, the water is drained through the plurality of drainage channels 2, and when the salinity is lower than the preset value, the water is stored with the excess drained.

Described above are merely preferred embodiments of this application, which are not intended to limit this application. Any modifications, replacements or improvements made by those skilled in the art without departing from the spirit and scope of the application should fall within the scope of the application defined by the appended claims.

What is claimed is:

1. A water-salt regulation system for coastal regions, the water-salt regulation system comprising:

an irrigation canal;

a plurality of drainage channels; and a shaft;

wherein the irrigation canal is configured to be arranged on a surface farmland, and is inclined from inland to sea;

the plurality of drainage channels are configured to be arranged inside a soil, and arranged along a vertical direction; the plurality of drainage channels are inclined from inland to sea; an inner peripheral wall of each of the plurality of drainage channels is detachably provided with a plurality of first filter mesh frames; the plurality of first filter mesh frames are each provided with an accommodating cavity; the accommodating cavity is provided with a filter filling material; and the shaft is provided with a first water port communicating with the irrigation canal and a second water port communicating with each of the plurality of drainage channels; a first sluice gate is provided at the first water port, and a second sluice gate is provided at the second water port; a salinity sensor is arranged inside the shaft; the shaft has a first state suitable for storing water with a salinity within a preset range and a second state suitable for draining water with a salinity exceeding the preset range; in the first state, the second sluice gate is closed; and in the second state, the second sluice gate is opened;

wherein a bottom of the shaft is provided with a gravel filter layer or a biochar filter layer, and a peripheral wall of the shaft is detachably provided with a plurality of second filter mesh frames.

2. The water-salt regulation system of claim 1, wherein both sides of the irrigation canal are each provided with a water vapor collection device; the water vapor collection device comprises a plurality of support frames and a collection mesh; the connection mesh is connected to the plurality of support frames, and covers a space between adjacent two support frames; the plurality of support frames have an extendable-retractable structure; the plurality of support frames on both sides of the irrigation canal are configured to be in contact when in a working state; in the working state, the plurality of support frames cover the irrigation canal and the shaft, and an inner side of the collection mesh is configured to collect water vapor to allow the water vapor to flow back to the irrigation canal or soils at both sides of the irrigation canal along the collection mesh.

3. The water-salt regulation system of claim 2, wherein each of the plurality of support frames comprises two fixed parts and two sliding parts; the two fixed parts each have an arc structure; one end of each of the two fixed parts is configured to be fixed in the soil, and the other end of each of the two fixed parts is configured to bend toward the irrigation canal; one side of the collection mesh is fixed at a connection between each of the two fixed parts and the soil, and the other side of the collection mesh is connected with the two sliding parts; and the collection mesh is configured to slide with the two sliding parts to cover the irrigation canal and the shaft.

4. The water-salt regulation system of claim 3, wherein an end of one of the two sliding parts is fixedly provided with a first connecting block, and an end of the other of the two sliding parts is fixedly provided with a second connecting block; the first connecting block and the second connecting block are respectively provided with a through hole, and through holes of the first connecting block and the second connecting block are aligned with each other; when the two sliding parts are in contact with each other, the first connecting block is in bolted connection with the second connecting block to fix the two sliding parts.

* * * * *